United States Patent [19]

Clothier et al.

[11] 4,014,432

[45] Mar. 29, 1977

[54] PRODUCT FOR TREATING FABRIC

[75] Inventors: George Ernest Clothier, Clwyd, Wales; Robert Lewis Davies; John Albert Hockey, Wirral, England; John Leonard Metcalfe, all of Wirral, England

[73] Assignee: Lever Brothers Company, New York, N.Y.

[22] Filed: Apr. 2, 1976

[21] Appl. No.: 673,337

[30] Foreign Application Priority Data

Apr. 9, 1975 United Kingdom ..... 14533/75

[52] U.S. Cl. ..... 206/0.5; 206/205

[51] Int. Cl.[2] ..... B44D 1/46

[58] Field of Search ..... 118/76–78, 118/506; 206/.5, 84, 525–527, 439, 497, 210, 205; 34/60

[56] References Cited

UNITED STATES PATENTS

| | | | |
|---|---|---|---|
| 1,800,692 | 4/1931 | Mahan | 206/.5 |
| 2,994,404 | 8/1961 | Schifterly | 206/.5 X |
| 3,634,947 | 1/1972 | Furgal | 34/60 |
| 3,870,145 | 3/1975 | Mizuno | 206/.5 |
| 3,948,387 | 4/1976 | Haertle | 206/.5 X |

*Primary Examiner*—Morris Kaplan

[57] ABSTRACT

A product for treating, e.g. softening, fabric in a tumble drier has a perforated membrane and means for generating pressure in the product to cause a conditioning agent to exude through the perforations onto the surface of the product where it is removed for application to the fabric. The pressure may be caused by using a heat-shrinkable or a stretched elastomeric membrane and the product is preferably attached inside the drier.

12 Claims, 11 Drawing Figures

PRODUCT FOR TREATING FABRIC

This invention relates to a product for the treatment of fabrics with conditioning agents. The products are particularly adapted for use in tumble drying machines, that is to say machines in which damp fabrics are tumbled whilst warm air is passed around them so as to remove the moisture.

The practice of washing clothes and fabrics has been found to have a harshening effect on the feel of the fabrics during subsequent wear or usage, especially in the case of cotton fabrics such as towelling. It has therefore been proposed to soften the fabrics by treating them with fabric softening agents in the tumble driers. For example, it has been proposed to spray a fabric softening agent on the inside of the drum of a tumble drier before putting the fabrics into the tumble drier, so that the fabric softening agent is rubbed off the drum onto the fabrics during the tumble drying; but this can lead to the build-up of a sticky residue on the drum. It has also been proposed to impregnate a piece of fabric with a softening agent and then to add it to the tumble drier with the clothes to be softened, so that the softening agent is transferred from the fabric to the clothes during tumble drying; but this is inconvenient as a new impregnated fabric piece usually needs to be used each time and this is relatively expensive.

According to the present invention, we have devised an improved product, especially for the treatment of fabric in tumble driers. The new product for applying a conditioning agent to fabric has a perforated membrane and pressure-generating means for exuding the conditioning agent through the perforations onto the outer surface of the product, from which surface the conditioning agent can be removed by the fabric during use. By using the product of the invention it is possible to obtain substantially uniform distribution of a fabric conditioning agent over the fabrics to be treated, and by adjustment of the amount of the fabric conditioning agent in the preferred products it is possible to use them for more than one tumble drying operation.

Products according to the present invention may take a variety of physical forms, although each still embodies the essential features of a perforated membrane and means for exuding the fabric conditioning agent through the perforations onto the surface. The perforated membrane preferably has a smooth surface with a number of small holes or slits in it, and preferably the perforations should be deformable to the extent of permitting passage of the conditioning agent under pressure but closing when the pressure is released so as to limit the exudation of the conditioning agent, for the optimum economy and efficiency. The number of holes or slits can be varied widely according to the size and type of product and the desired rate of exudation of the fabric conditioning agent through the perforations, from a minimum of one up to a practical maximum of about 1,000, preferably from about 10 to about 200. Usually a perforation density of about 1 to about 10 perforations per $cm^2$ will be employed, but this need not extend over the whole membrane surface.

It should be appreciated that the perforations in the membrane can be closed initially or covered by a layer of protective material which is removed before use. The perforations themselves may also be made in the membrane either before or during manufacture of the product, or they may be made in the otherwise finished product immediately prior to use.

The perforated membrane may be made of flexible, elastomeric or relatively rigid material, depending on the material of construction and the thickness of the surface material. If desired, however, the surface of the membrane may be rough, as for example with a woven or non-woven fabric facing, e.g. of velvet, or with indentations on a moulded or embossed surface, or it may be formed of solid permeable foam, for example of plastics or rubber. It may be advantageous to site the perforations in specific relationship to features on the surface, for example a ribbed or otherwise indented surface can be made with perforations in the bases of the channels between the ribs so as to facilitate movement of the fabric conditioning agent onto the surface and promote uniform removal of the conditioning agent during the treatment of fabric in a tumble drying operation. The provision of an adsorbent fabric facing over the perforated membrane can be advantageous in promoting uniform application of the fabric conditioning agent to the treated fabric and decreasing visible accumulations of the conditioning agent on the outside of the product after use.

The product as a whole must have some three-dimensional shape so as to contain fabric conditioning agent behind the perforated membrane, with means for exuding the conditioning agent through the perforations onto the surface during use. Thus, the product may have its outer surface formed substantially solely of the perforated membrane mentiond, or it may have only part of its surface carrying the perforated membrane, in which case it also has a relatively rigid base supporting the membrane.

When the product has only a single perforated membrane at its outer surface, then the whole of that surface of the membrane must of course be free to contact fabric during tumble drying. In this event the product may have, for example, a spherical, cylindrical or disc shape and it will normally be allowed to move freely in the tumble drier in which the fabric is being dried. However, where only part of the external surface of the product is perforated, then it is desirable, but not essential, to be able to attach the product to the interior of the tumble drier, so that the perforated surface is better exposed for releasing the fabric conditioning agent. Ways by which the product according to the invention can be attached to the interiors of the tumble driers include, for example, pressure-sensitive adhesives, mateable woven loop and hook fastenings, e.g. of the "Velcro" (trademark) type, suction cups, or knobs, hooks or strings on the base of the product for using in co-operation with holes or protrusions in or on the interior of the drum surface or the door of the tumble drier.

As described above, the product contains a fabric conditioning agent which is exuded through the perforations onto the surface of the product during use in a tumble drier. Preferably the conditioning agent is a solid at room temperature but melts or softens at a temperature reached during the treatment of the fabric, usually in the region of about 38° C to about 80° C in tumble drying operations. The conditioning agent can then be exuded through the perforations when at high temperatures, but it solidifies again when the treatment is finished and the temperature drops. However, the conditioning agent may be a liquid or pastry material, and in the former case there should be some way of preventing the release of the conditioning agent through the perforated membrane until treatment of the fabric is intended to commence.

The fabric conditioning agent is caused to exude through the perforated membrane of the product by pressure exerted on the conditioning agent within the product. There are several ways in which this can be done, by either external or internal pressure generating means. For example, the membrane or other outer surface material of the product may be of plastics material which tends to shrink on heating, so that during the treatment of the fabric when the temperature rises, the shrinkage of the plastics material causes the pressure inside the product to rise, whereupon some of the conditioning agent is exuded through the perforations. If the conditioning agent is normally a solid material at room temperature as preferred, the increased temperature should of course cause it to soften sufficiently to pass through the perforations. Alternatively, part or all of the outer surface of the product may be made initially of an elastomeric material in a stretched condition, which continuously causes some pressure on the conditioning agent inside the product, though if the conditioning agent is normally a solid, the pressure in the product will only cause exudation of the conditioning agent when it is softened sufficiently as the temperature rises during a tumble drying operation.

In an alternative way of causing internal pressure on the fabric conditioning agent, it is possible to include within the product some means for causing such pressure, for example a device which tends to expand when heated, for example by the liberation of a gas from a solid or liquid material. Such a device can be made to give either progressive expansion by being formed of flexible material, or it may give sudden expansion when the pressure rises very quickly causing the rupture of the device. For example a liquefied gas may be contained in an inner plastic sachet within the product, so that the sachet ruptures when the temperature rises during tumble drying. In such a product the conditioning agent may be contained either in the inner sachet with the liquefied gas or between the inner sachet and the outer perforated membrane, the former being better in the case of liquid conditioning agents and the latter better for solid, meltable fabric conditioning agents.

In a further embodiment of the invention, the shape of the product may itself by such as to generate internal pressure on the fabric conditioning agent when the product is used, for example by tending to alter the shape of the product and so decrease its volume, when it is attached to the internal surface of the tumble drier, for example by using retaining straps or other means which tend to compress the product against the interior surface of the tumble drier.

Further ways of generating internal pressure within the products include, for example, the use of bimetallic strips in the products.

The preferred conditioning agents used in the products of the invention are so-called softening agents, as they make the fabrics feel softer to the touch. Many fabric softening agents are quaternary ammonium compounds, having the general formula $$[N^+(R_1R_2R_3R_4)]_n, X^- \quad (I)$$

wherein $R_1$ is a $C_{16}$ to $C_{22}$ alkyl group, $R_2$ is a $C_1$ to $C_4$ alkyl group and $R_3$ and $R_4$ are the same as $R_1$ or $R_2$, and any of $R_1$, $R_2$, $R_3$ and $R_4$ may be saturated or unsaturated, linear or branched chain alkyl groups or they may contain substituent groups, e.g. hydroxy groups, or $R_1$, $R_2$, $R_3$ and $R_4$ may be connected to the nitrogen atom with linking groups, e.g. amide, ester or ether linkages, of 2 or 3 of $R_1$, $R_3$ and $R_4$ may be conjoined with the N atom to form a heterocyclic ring such as a morpholinyl ring, X is an anion and n is the valency of X. Suitable anions ($X^-$) are $Cl^-$, $HSO_4^-$, $SO_4^{--}$, $C_2H_5SO_4^-$, $CH_3SO_4^-$, $HCOO^-$, $CH_3COO^-$, $Br^-$, $I^-$ and $H_2PO_4^-$, of which the chloride, sulphate, bromide and acetate ions are preferred. Typical commercial products of this type are di-tallow-dimethyl ammonium chloride, dicoco-dimethyl ammonium chloride, di-(stearoyloxyethyl)dimethyl ammonium chloride and 3-behenoyloxy-2-hydroxypropyl trimethyl ammonium chloride.

Other preferred softening agents are the reaction products of about 2 moles of a fatty acid of the formula $R_4COOH$ and a hydroxyalkyldiamine of the formula:

$$NH_2—R_5—NHR_6 \quad (II)$$

wherein $R_4$ is a $C_{15}$ to $C_{19}$ alkyl group, $R_5$ is a $C_1$ to $C_3$ divalent hydrocarbon group and $R_6$ is a hydroxyalkyl group containing 1 to 3 carbon atoms. A typical commercial product of this type is the reaction product of 2 moles of stearic acid with 1 mole of hydroxyethyl ethylene diamine, which has a mixed chemical structure because of the multifunctional nature of the diamine. Similar products include the quaternised products of about 2 moles of oleic acid reacted with 1 mole of hydroxyethyl ethylene diamine and the product of about 2 moles of a mixture of oleic and stearic acids reacted with 1 mole of hydroxyethyl ethylene diamine. The softening agents are preferably used in admixture with a nonionic surfactant.

Other types of fabric softening agents which may be used in the present invention are known in the art and described in the literature, for example in "Proceedings of the American Association of Textile Chemists and Colorists", American Dyestuff Reporter, pages P42 and P43, Jan. 28, 1957.

Other conditioning agents which can be employed in the product of the invention, either alone or in admixture, especially in admixture with fabric softening agents as described above, include:

1. Optical brighteners, ie fluorescent brightening agents, such as substituted disulphonated diaminostilbene compounds, for example as disclosed in U.S. Pat. No. 2,612,501, or triazole compounds of the type disclosed in U.S. Pat. No. 2,784,183.

2. Essential oils and fragrances.

3. Antistatic agents, which in many cases are compounds of the same general structures discussed above with respect to fabric softening compounds. Specific antistatic agents which may be mentioned by way of example are ethoxylated compounds such as ethoxylated amines, ethoxylated quaternary ammonium compounds, ethoxylated aliphatic alcohols or alkyl phenols, ethoxylated carbohydrates such as sorbitol ethoxylates, ethoxylated aliphatic mono- or di-carboxylic acids, and amides or esters thereof, or polyethylene glycols. The antistatic properties of the preferred quaternary ammonium compounds as well as other fabric softening agents may be enhanced in particular by combining these materials with ethoxylated amides such as tallow ethanolamides, or ethoxylated aliphatic alcohols.

4. Germicides, such as the halogenated salicylanilides, eg tribromosalicylanilide, hexachlorophene, neomycin sulphate, benzalkonium quaternary compounds, and the like.

5. Bodying agents, such as carboxymethylcellulose, hydroxyethylcellulose, starch, polyvinyl acetate and the like. Polyvinyl acetate is also effective to improve ease of ironing and may be employed for that purpose.

6. Soil release agents, such as polyacrylic polyvinyl alcohol compositions described, for example, in U.S. Pat. No. 3,337,249, or copolymers of ethylene glycol with terephthalic acid which are useful for treating polyester fabrics for this purpose.

7. Ironing aids, for example silicones such as dimethyl silicone; and

8. Surface active agents, which are used with other conditioning agents, for example nonionic surfactants used with quaternary ammonium fabric softening agents. In this case it is preferred to have a ratio of the cationic quaternary ammonium compound to the nonionic compound of about 70:30 to about 95:5, especially about 90:10 parts by weight.

It will be appreciated that several of the fabric conditioning agents described above are normally solid materials, i.e. at elevated temperatures as well as at room temperatures, in which case they should be employed either in aqueous solution or dispersion, or in solution or dispersion in another fabric conditioning agent which is either liquid or a meltable solid. The preferred conditioning agents are meltable solids which have a low latent heat of fusion so that they melt rapidly and, more importantly, solidify rapidly on cooling so as to facilitate multiple use. It is also preferred that the conditioning agent when liquid should exhibit viscostatic properties so as to control the liberation of the fabric conditioning agent at higher temperatures. Optimum viscosities are within the range of about 20– poise, preferably about 30–100 poise, at a shear rate of 147 $sec^{-1}$ and at 55° C. The viscosity of a composition at a shear rate of 147 $sec^{-1}$ can be measured in a Haake Rotovisco concentric cylinder viscometer.

The amount of fabric conditioning agent used in a product of the invention depends of course on the type of agent and the type of product, especially if multiple use is intended, and the optimum levels can readily be determined. For example in the case of a fabric softening agent, it is normally preferred to have about 2 to about 5 $cm^3$ of liquid fabric conditioning agent available for application to a typical single domestic fabric load in a tumble drier. Products intended for multiple use should contain proportionately more fabric conditioning agent.

It is possible to use more than one product at a time in a fabric tumble drying machine so as to secure sequential release of fabric conditioning agents during the drying cycle, for example by release of the contents at different temperatures, or for the simultaneous treatment of different types of fabrics. It may, for example, be particularly advantageous to secure the release towards the end of the fabric treatment of certain conditioning agents such as germicides or perfumes, especially if they interfere with or they are inhibited by other fabric conditioning agents.

Products according to the invention are illustrated by way of example in the accompanying drawings of which:

Figure 1:
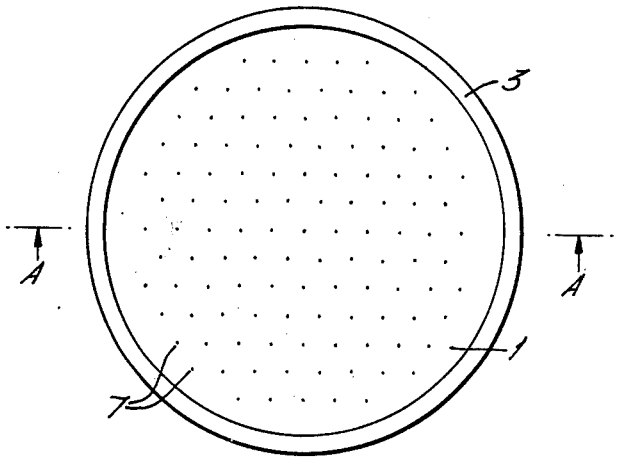
FIG. 1 is a plan view of a product taking generally the shape of a segment of a sphere.
Figure 2:
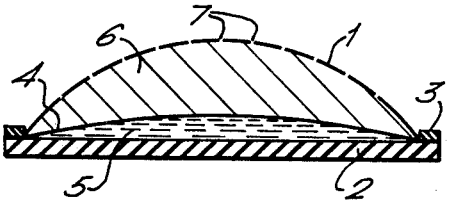
FIG. 2 is a cross-sectional elevation of the product of FIG. 1 on the line A—A.

In FIGS. 1 and 2, a curved perforated thin flexible rubber membrane 1 is adhesively secured at its periphery to a rigid circular rubber back 2 by a rubber ring 3. Within the space defined by the rubber membrane 1 and the back 2 a second flexible curved rubber membrane 4 is also adhesively secured at its periphery between the back 2 and the ring 3. The space 5 confined between the membrane 4 and the back 2 is filled with a liquid substance which liberates a gas when heated so as to expand in volume by stretching the membrane 4. The space 6 between the two membranes 1 and 4 is filled with a solid, meltable fabric conditioning agent. In the outer membrane 1 are a large number of very small perforations 7 (not drawn to scale in FIG. 2). The contents of both chambers within the product of FIGS. 1 and 2 are placed therein by injection through hollow needles, followed by adhesive sealing of the holes where necessary.

During use of the product shown in FIGS. 1 and 2, the product is preferably attached to an internal flat surface of a tumble drier, for example by a pressure-sensitive adhesive or by mateable woven loop and hook fasteners (not shown) on the flat back 2, in a position where the outer surface of the membrane 1 can be rubbed by fabrics being tumbled during the drying process. When the tumble drier is operating, the temperature rises so as to melt the fabric conditioning agent under membrane 1 and to cause liberation of gas from the liquid within space 5. The increase in pressure within the product causes some of the fabric conditioning agent to exude through the perforations 7 where it is rubbed off onto fabrics being dried.

In a particular test of a product made as described in FIGS. 1 and 2, the fabric softening effect achieved was compared with that obtained using a commercially available aqueous liquid fabric softening product which is added manually to the final rinse water in a spin dryer, after washing the fabric normally. The control product was used at recommended dosage under recommended conditions to treat samples of long-loop cotton terry-towelling fabric and then the fabric was tumble dried under normal conditions (without treatment with any additional softening agent).

The product according to the present invention had a diameter of about 3 inches (8 cms) and contained in space 5 a carbonic acid solution, which liberates carbon dioxide on heating, and in space 6 about 5 $cm^3$ of a meltable fabric softening agent (an 80:20 mixture of di-hardened tallow dimethyl ammonium chloride recrystallised from acetone and an ethoxylated alcohol nonionic surface active agent obtained as Tergitol 15-S-12 (trademark), which becomes fluid at about 43°–50° C). This product was used in a commercially available tumble drier for 30 minutes to treat similar samples of long-loop cotton terry-towelling fabric which had been similarly washed and then spun dry but without the fabric softening treatment in the spin drier.

Comparison by a panel of 20 people, of the feel of the cloths treated by both products, showed that in both cases there was a very noticeable improvement in the soft feel compared with untreated cloth. The product according to the invention achieved this without the inconvenience of the separate rinsing operation when using the comparative conventional product.

In an alternative construction of a generally segment shaped product similar to that shown in FIGS. 1 and 2, the membrane 1 is constructed of heat-shrinkable film, and the inner membrane 4 and resultant space 5 are omitted, as an alternative way of generating pressure in the product during use. In this event it is preferred to provide the back 2 with an inner convex surface.

Figure 3:
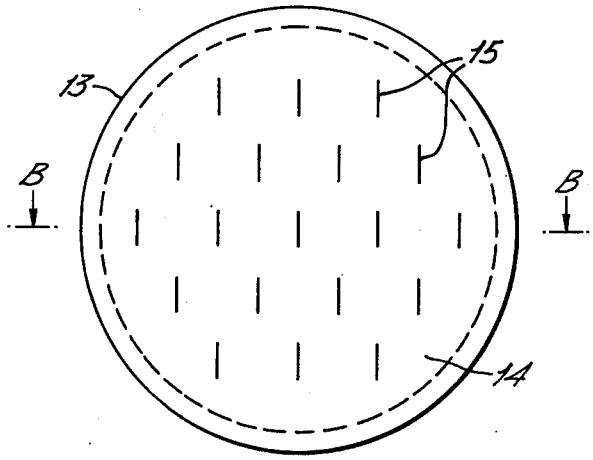
FIG. 3 is a plan view of a generally cylindrical product.
Figure 4:
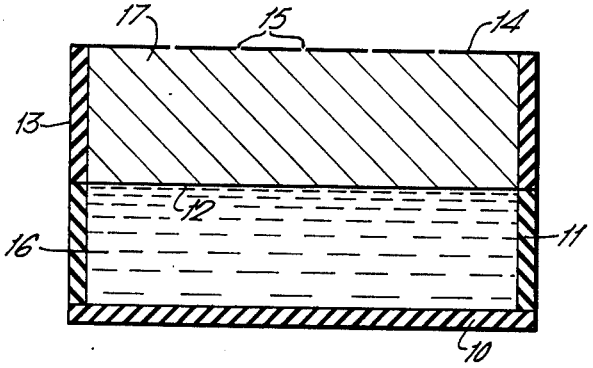
FIG. 4 is a cross-sectional elevation of the product of FIG. 3 on the line B—B.

In FIGS. 3 and 4, a generally cylindrical product has a fairly rigid circular rubber back 10 adhesively bonded to a short cylindrical tube 11. The other end of the tube 11 is adhesively bonded to a thin flexible elastomeric membrane 12 and this in turn is bonded to a second short cylindrical tube 13 coaxially with the first tube 11. At the other end of the tube 13 a further thin flexible rubber membrane 14 is again adhesively bonded to the tube. The rubber membrane 14 has several short parallel slits 15 in it (not drawn to scale). The space 16 between the back 10 and the non-perforated membrane 12 is filled with a liquid which liberates a gas on heating, e.g. carbonic acid solution, whilst the space 17 between the two membranes 12 and 14 contains a fabric conditioning agent. As with the product of FIGS. 1 and 2, the compartments in the product were filled by injection through hollow needles, and the amount of conditioning agent used was about 5 $cm^3$.

During use of this product to soften fabrics in a tumble drier, the rise in temperature causes the carbonic acid solution to liberate carbon dioxide and thus to extend the membrane 12 under increasing pressure. This in turn increases the pressure on the fabric conditioning agent which forces open the slits 15 in the membrane 14 so that some of the fabric conditioning agent exudes onto the outer surface of the membrane 14 from which it is removed by fabric during tumble drying. This product is of course not fastened to the drier drum, but is freely tumbled with the fabric during drying.

A practical evaluation test was undertaken using a product as described above with reference to FIGS. 3 and 4, using the same procedure as described above for the product of FIGS. 1 and 2. It was found that the product according to the invention softened fabric effectively in comparison with untreated fabric, though this was less effective than with the product of FIGS. 1 and 2.

A further evaluation test was undertaken of a product as in FIGS. 3 and 4, except that the slits were replaced by a larger number of very small holes, and that the fabric softener used was approximately 6 grams of a 1.8% aqueous solution of 3-alkoyloxy-2-hydroxypropyl trimethyl ammonium chloride (the alkyl group was derived from rape seed oil and contained about 64% $C_{22}$, about 22% $C_{18}$ and about 12% $C_{20}$ alkyl groups). In this case the device was fastened inside the drum of a tumble drier, and then used to treat terry-towelling fabric for 30 minutes. It was found that the treated fabric felt softer than comparative untreated fabrics by 31 out of 32 persons. Subsequently it was determined that about 3.9 grams of the softener solution were discharged from the product during the test.

The same procedure was also repeated except that the product contained about 6 grams of an aqueous 4.8% solution of lauryl dimethyl ammonio propane sulphonate. In this case about 5.8 grams of solution were discharged and it was found that 25 out of 26 persons then preferred the feel of the treated fabric.

Figure 5:
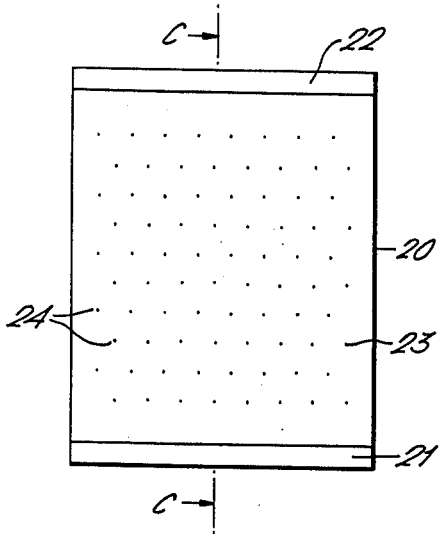
FIG. 5 is a plan view of a product of sachet form.
Figure 6:
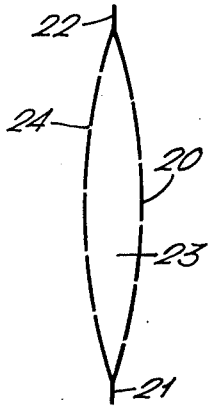
FIG. 6 is a cross-sectional elevation of the product of FIG. 5 on the line C—C.
Figure 7:
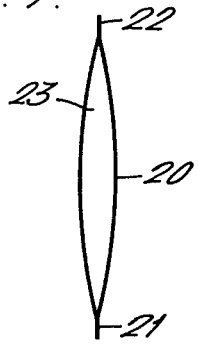
FIG. 7 is a cross-sectional elevation of the product of FIG. 5 on the line C—C, after use of the product.

FIGS. 5 and 6 show a product of sachet form, and in FIG. 7 the same product is shown after use. In these FIGURES the sachet is in the form of a flexible thin plastic tube 20 which has been heat sealed at the ends 21 and 22 in the same plane, (but heat sealing in different planes especially at right angles to give tetrahedral-shaped sachets is also possible). The closed tube 20 encloses a space 23 which is filled with a solid, meltable fabric conditioning agent. In the walls of the tube 20 are a large number of very small holes 24 (not drawn to scale in FIG. 6, and not shown in FIG. 7). The tube is made of a flexible plastic material, e.g. modified polystyrene or modified polyethylene, which is stretched during manufacture and tends to shrink on heating.

The product is intended to be used loose in a tumble drier machine where the rise in temperature softens the fabric conditioning agent and also causes the tube to tend to shrink, so that the pressure within the product increases, and some of the fabric conditioning product is thereby exuded onto the outer surface, from which it is removed by contact with fabric being tumble dried. After use the product is naturally smaller and thinner, as shown in FIG. 7. In a practical evaluation test of a product of this nature, following the procedure for the product of FIGS. 1 and 2, fabric was effectively softened in a tumble drier.

Figure 8:
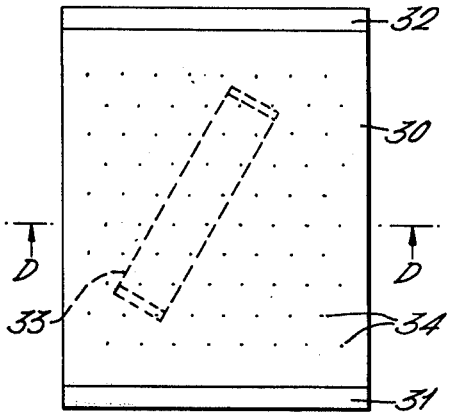
FIG. 8 is a plan view of an alternative product in sachet form.
Figure 9:
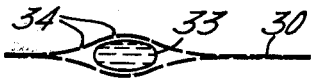
FIG. 9 is a cross-sectional elevation of the product of FIG. 8 on the line D—D.

In FIGS. 8 and 9 a further product of sachet form is shown constructed of a plastic tube 30 sealed at both ends 31 and 32 in the same plane. Within the outer sachet there is an inner plastic tube 33 also sealed at both ends but made of thinner material. The outer tube 30 has many small perforations 34 (not drawn to scale). The inner tube is filled with a mixture of a liquefied gas, e.g. a fluorinated hydrocarbon of the type used as an aerosol propellant such as "Arcton" (trademark), and a liquid fabric softening agent (a perfumed, coloured aqueous solution of di-hardened tallow methyl ammonium chloride). The space between the inner and outer tubes is empty.

In use the product is added with fabric to be dried in a tumble drier. When the temperature rises it causes the pressure to rise in the inner tube until the plastic wall ruptures and the contents are expelled into the outer tube, from which they escape through the perforations, and the fabric softening agent is then rubbed off onto the fabric. In a practical test of a product of this type, fabric was effectively softened in a tumble drier.

In a further test, about 10 $cm^3$ of a 1.8% aqueous solution of the 3-alkoyloxy-2-hydroxypropyl trimethyl ammonium chloride (alkyl derived from rape seed oil) as described above was placed in the outer sachet of a product constructed otherwise as shown in FIGS. 8 and 9, whilst 2.75 grams of liquefied gas propellant Arcton 11 was placed in the inner sachet. The product was then used to treat fabric in a tumble drier, and it was found that 7.8 grams of the softener solution and propellant were discharged during the treatment. This test was also repeated using about 10 $cm^3$ of a 4.8% aqueous solution of lauryl dimethyl ammonio propane sulphonate, when again it was found that the treated fabrics were softer than the control, untreated fabrics, and 8.25 grams of the softener solution and propellant were discharged during use.

Figure 10:
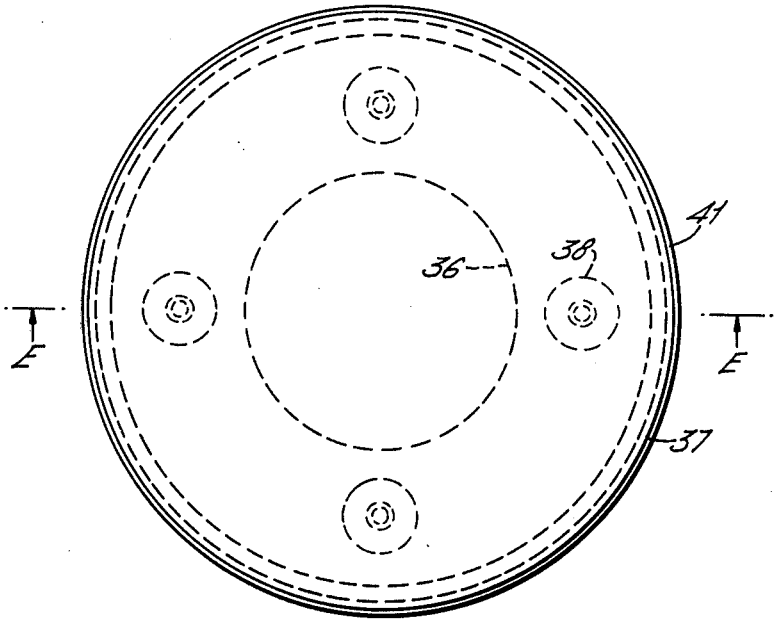
FIG. 10 is a plan view of an alternative product generally of convex disc shape.
Figure 11:
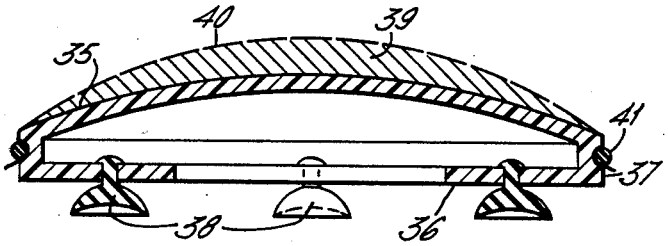
FIG. 11 is a cross-section elevation of the product of FIG. 10 on the line E—E.

In FIGS. 10 and 11, a moulded plastic base 35 has a convex disc shape with an inward facing circular ledge 36 projecting from the edge 37 of the disc. Four rubber suction cups 38 (only three are shown in FIG. 11) are located in holes in the ledge 36 with the cups projecting outwards for attachment of the product to the drum or other internal surface of a tumble drier. A solid block 39 of fabric conditioner which takes the general shape of a positive meniscus lens is located against the outer face of the plastic base 35, and is covered by a perforated stretched thin rubber membrane 40 which is held in place by an elastic ring 41 located in a groove of semi-circular cross-section in the edge 37 of the plastic base.

The product of FIGS. 10 and 11 is made by firstly inverting the moulded plastic base with suction cups in a concave mould containing a predetermined amount of a molten fabric conditioning agent, which then solidifies on cooling to form a curved layer on the base. The stretched rubber membrane is then secured over the layer of the fabric conditioning agent by pressing the coated base over a sheet of rubber, and when the sheet is sufficiently stretched, securing it by locating the elastic ring 41 in the peripheral groove of the base. The sheet of rubber is perforated either before or after securing it over the fabric conditioning agent.

In use, the heat in a tumble drier melts the fabric softener, whereupon the tension in the rubber membrane causes the molten fabric softener to exude through the perforations onto the outer surface of the membrane where it is removed by contact with the fabric being treated.

In a specific product made as shown in FIGS. 10 and 11, the base had a diameter of 10 cms and the weight of the fabric softening composition was about 25 grams. The rubber membrane used had a thickness of about 0.01 inch and the initial tension in the rubber gave a pressure of about 43 grams/$cm^2$ on the fabric softening composition. There were 20 holes in the rubber membrane of about 0.75 mm diameter each. It was found that a 90:10 parts by weight mixture of di-hardened tallow dimethyl ammonium chloride and sec-linear-$C_{11}$–$C_{15}$ alcohol -12 EO condensate (Tegitol 15-S-12) had a suitable viscosity of about 60 poise (measured at a shear rate of 147 $sec^{-1}$ and at 55° C) for regular delivery of the mixture through the perforated membrane during use.

Using this product to treat towelling fabric in an English Electric tumble drier for 45 minutes, it was found that effective fabric softening could be achieved for up to 10 re-use cycles. This product was compared for its fabric softening properties against a commercially available product for the same purpose which comprises a solid block of fabric softener inside a fabric envelope which in use is secured to the wall of the tumble drier. It was found that less than 0.5 gram of the softener was released from the comparative product per fabric drying cycle, compared with 2 to 3 grams of fabric softener per cycle using the product according to the invention. In consequence the fabric treated according to the invention was found to feel softer after up to 10 drier cycles. When 1% of a perfume was added to the same fabric conditioning composition in the product, it was found that besides the softening effect it was also possible to impart to treated fabric a pleasing lasting fragrance for up to 5 cycles with a single product.

Other products were prepared using different fabric softening compositions, namely a mixture of 90:10 parts by weight 3-alkoyloxy-2-hydroxypropyl trimethyl ammonium chloride (with the alkyl derived from rape seed oil) and Tergitol 15-S-12, and a 50:50 mixture of a condensation product of 2 moles of stearic acid with 1 mole of N-hydroxyethylenediamine and Tergitol 15-S-12. These mixtures gave regular deliveries of about 2.5 grams each for 5 tumble drier cycles, with effective fabric softening, after which the deliveries were decreased and became less effective.

A product was prepared as shown in FIGS. 10 and 11, using 25 grams of a fabric conditioning composition which was a 50:50 mixture of di-hardened tallow dimethyl ammonium chloride and a copolymer of ethylene glycol and terephthalic acid (formed by reacting 2 moles of the former with 1 mole of the latter and then reacting the product with additional polyethylene glycol, obtained as Permalose T (trademark)). This product was used to treat polyester fabric in a tumble drier over 10 drier cycles, when it was found that the polyester fabric acquired satisfactory antistatic and anti-soiling properties during subsequent use.

The product of FIGS. 10 and 11 was also used to treat fabric with a fluorescent agent by using a 24:1 mixture of tallow alcohol - 50 EO and disodium 4,4′di(-2″-anilino-4″-diethanol aminotriazin-6″-ylamino)-stilbene-2,2′-disulphonate (obtained as Photine C (trademark)). It was found that cotton sheeting dried in a tumble drier using the product improved in apparent whiteness under artificial lighting, and the effect could be achieved over several drying cycles with the same product.

Further tests were undertaken using a product as shown in FIGS. 10 and 11 except that the four suction cups were replaced by wire clips holding the product onto the grill covering the vent of the tumble drier, and equally satisfactory results were obtained. In further products, the perforated rubber membrane was covered by sheet foam (2 mm thick) or woven fabric coverings. It was found that brushed nylon and woven filament polyester fabrics were the most effective for decreasing the formation of lumps of solid fabric conditioning composition on the outside of the product after use, and hence for improving the even application of the fabric conditioning agent to the products during multiple drying cycles.

A further embodiment of the invention comprises two generally spherical elastomeric membranes, one inside the other, with the outer one only being perforated and with a solid meltable fabric conditioning agent lying between the two membranes. The product is inflated by air pressure in the inner membrane only so as to give the overall spherical shape, though other rounded shapes can also be used, with a diameter or maximum dimension of about 2 inches to about 9 inches. After inflation of the inner membrane the outer one is of course sealed to prevent loss of the fabric conditioning agent.

In use the product becomes heated during tumble drying and the fabric conditioning agent melts and is then caused by the pressure within the inner membrane to exude through the perforations in the outer membrane, where it is removed by contact with the tumbling clothes. In a practical evaluation of a product of this type having a diameter of about 3 inches and containing about 5 grams of the fabric conditioning agents used in the product of FIGS. 1 and 2, cotton fabrics were effectively softened in a domestic tumble drier and nylon fabrics became effectively free from static electricity.

Other sachet forms of products which may be mentioned include multi-compartment sachets which contain in each compartment fabric conditioning agents which are mutually incompatible in storage but which can be used simultaneously or sequentially to treat fabric. With such sachets the whole or part of the product can be made of heat-shrinking plastic material, for example in a two compartment sachet of back-to-back construction, the internal common wall can be of heat-shrinkable plastic film or sheet to cause contraction of the whole sachet in use.

What is claimed is:

1. A product for the treatment of fabric in a tumble drier, comprising a perforated membrane pressure-generating means for exuding a conditioning agent through the perforations onto the surface of the product from which the conditioning agent can be removed by the fabric during use, said conditioning agent being normally solid but softenable upon application of heat during usage, and said membrane being heat shrinkable whereby to effect said pressure generation and exuding of the conditioning agent during use.

2. A product according to claim 1, wherein the perforated membrane is supported by a relatively rigid base.

3. A product according to claim 2, wherein the base is of generally circular shape and the membrane is attached to the base at the edge thereof.

4. A product according to claim 1, comprising means for attaching the base to the interior of a tumble drier.

5. A product according to claim 1, wherein the outer surface is formed substantially solely of the perforated membrane.

6. A product according to claim 5, wherein the product is of sachet form.

7. A product according to claim 1, wherein the membrane has from about 10 to about 200 perforations.

8. A product according to claim 1, wherein the membrane is covered with an outer woven or non-woven fabric facing.

9. A product according to claim 1, wherein the fabric conditioning agent comprises a fabric softening agent.

10. A product according to claim 9, wherein the fabric softening agent is a quaternary ammonium compound.

11. A product according to claim 10, wherein the quaternary ammonium compound is admixed with a nonionic surfactant in the ratio of about 70:30 to about 95:5 parts by weight.

12. A product according to claim 1, wherein the fabric conditioning agent comprises an anti-static agent.

* * * * *